US005819959A

United States Patent [19]

Martin

[11] Patent Number: 5,819,959

[45] Date of Patent: Oct. 13, 1998

[54] MODULAR PIVOTAL SUSPENSION RIGGING APPARATUS

[76] Inventor: Andrew T. Martin, 1355 Loma Ave. #318, Long Beach, Calif. 90804

[21] Appl. No.: 785,690

[22] Filed: Jan. 17, 1997

[51] Int. Cl.[6] ..... A47F 5/08

[52] U.S. Cl. ..... 211/118; 211/175; 211/182; 403/59; 312/8.16; 248/323

[58] Field of Search ..... 211/118, 117, 211/175, 182; 248/241, 244, 323; 403/59, 379, 378, 157; 32/645; 181/144, 148, 199; 312/8.16, 201

[56] References Cited

U.S. PATENT DOCUMENTS

| | | | |
|---|---|---|---|
| 943,174 | 12/1909 | Beard . | |
| 3,782,065 | 1/1974 | Griffing . | |
| 3,785,108 | 1/1974 | Satchell | 52/645 |
| 3,911,221 | 10/1975 | Wong . | |
| 3,942,904 | 3/1976 | Morris | 403/379 |
| 3,964,612 | 6/1976 | Skilliter . | |
| 4,014,597 | 3/1977 | Griffin . | |
| 4,179,008 | 12/1979 | LeTourneau . | |
| 4,190,738 | 2/1980 | Samuels . | |
| 4,272,972 | 6/1981 | James . | |
| 4,651,963 | 3/1987 | Busse et al. . | |
| 4,660,728 | 4/1987 | Martin . | |
| 4,673,057 | 6/1987 | Glassco . | |
| 4,757,544 | 7/1988 | Guy . | |
| 4,805,730 | 2/1989 | O'Neill et al. . | |
| 4,880,203 | 11/1989 | Holcomb et al. | 248/241 |
| 4,979,785 | 12/1990 | Richards . | |
| 4,998,702 | 3/1991 | Reuter et al. | 403/157 |
| 5,139,223 | 8/1992 | Sedighzadeh . | |
| 5,258,584 | 11/1993 | Hubbard . | |
| 5,266,751 | 11/1993 | Taguchi . | |
| 5,360,192 | 11/1994 | Pittella . | |
| 5,368,270 | 11/1994 | Wiwczar . | |
| 5,602,366 | 2/1997 | Whelan et al. | 181/148 |
| 5,615,783 | 4/1997 | Warnken | 211/118 |

FOREIGN PATENT DOCUMENTS

| | | |
|---|---|---|
| 567115 | 5/1958 | Belgium . |
| 0 195 446 A2 | 9/1986 | European Pat. Off. . |
| F 16 M 13/00 | 11/1992 | Germany . |
| 2 195 139 | 3/1988 | United Kingdom . |

*Primary Examiner*—Peter R. Brown
*Assistant Examiner*—Anthony D. Barfield
*Attorney, Agent, or Firm*—Fulwider Patton Lee & Utecht, LLP

[57] ABSTRACT

Truss bars are pivotally joined together through locking slip sleeves and are locked at selected splay angles relative to one another by a locking splay bar. The truss bars support columns of audio equipment cabinets with lengths of cabling attached to pivotal plates locked into mounting brackets installed in the side walls of the cabinets. The columns of cabinets are tilted by cables connecting a pull back clip installed on the bottom most cabinet of each column to the rear of an extension bar removably mounted to each truss bar.

5 Claims, 6 Drawing Sheets

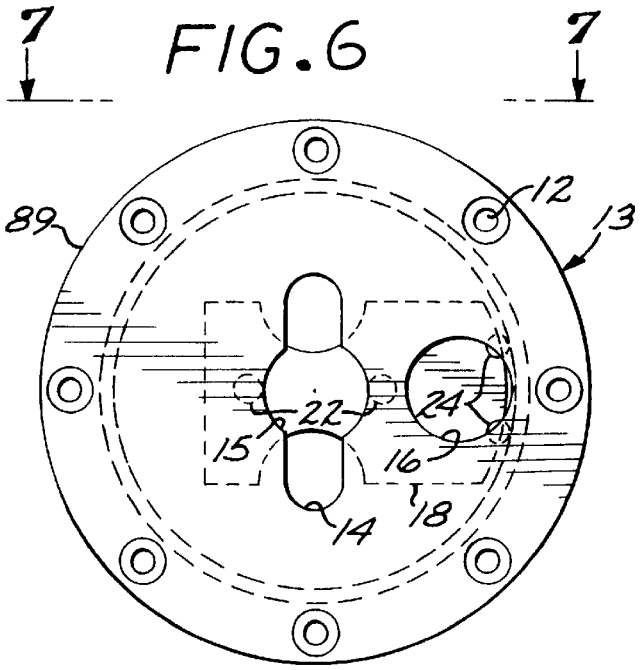
FIG. 6
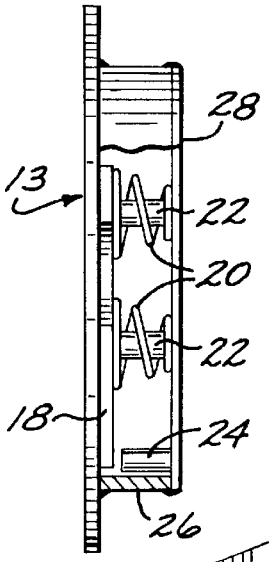
FIG. 7
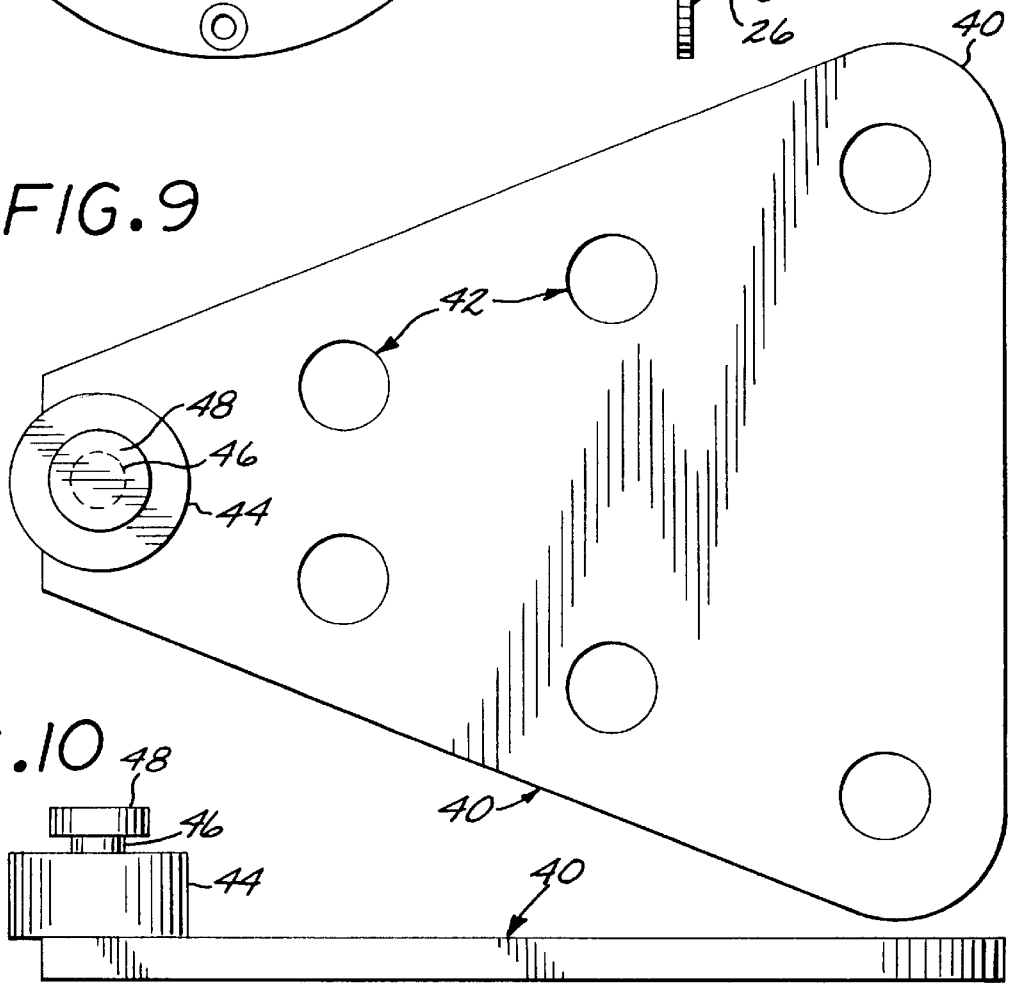
FIG. 9
FIG. 10

MODULAR PIVOTAL SUSPENSION RIGGING APPARATUS

BACKGROUND OF THE INVENTION

1. Field of the Invention

The present invention relates to loudspeaker suspension systems, and more particularly to a system of coupling devices and interconnected trusses by means of which multiple audio equipment cabinets may be suspended from an overhead framework.

2. Description of the Prior Art

Communicating to large audiences assembled typically in expansive concert halls or arenas requires the capability to project highly amplified audio signals through multiple arrays of powerful loudspeakers for the audience to intelligibly hear the intended sounds. Entertaining such an audience requires an even higher degree of sound fidelity, especially in the case of musical entertainment which covers a much broader range of the audible spectrum than that for mere speaking. The loudspeakers used in such instances are often arranged in spatially precise orientations such that the sound produced is distributed in a selected pattern to produce nearly equal reception throughout the forum occupied by the audience. In this manner, a person standing at one end of the forum perceives sounds of equal magnitudes and frequencies as the sounds perceived by another person standing at any other end of the forum.

It has been found that the quality of the sound reproduced is highly dependent upon the placement of the loudspeakers in the arena and their orientation with respect to one another. It is known in the art of loudspeaker array design that a loudspeaker suspension system should not displace the acoustic wavefront alignment of the loudspeakers in relation to one another. Displacement of this alignment results in a dramatic increase in comb filtering due to the various loudspeakers canceling each other's output at certain frequencies and greatly amplifying it at other frequencies. This comb filtering effect causes lobing and reduces the intelligibility of the loudspeaker system as a whole. It is therefore an important requirement for loudspeaker suspension systems to provide for different spatial orientations of the various loudspeakers with respect to one another.

Additionally, it is known in the art that the acoustic centers of loudspeakers in an array should not be displaced from a designated single point source in space. Misalignment of the acoustic centers will likewise cause dramatically increased comb filtering. However, because each loudspeaker's acoustic center is usually located within the loudspeaker cabinet itself, aligning the acoustic centers of multiple loudspeakers in an array to a single point in space can be very difficult.

Frequently it is also necessary to tilt columns of speakers to provide the required sound coverage of a large arena, or when part of the audience is seated in close proximity to the speakers. By tilting a column of speakers the sound generated is focused forward as well as downward, and all areas occupied by the audience experience equal sound coverage.

In addition to sound quality, modularity and portability are very important considerations in loudspeaker array suspension design. Arenas accommodating upwards of thousands of people can require hundreds of large loudspeakers and assorted sound processing and amplifying equipment. A typical touring band will, during any single tour, perform at numerous different arenas and will typically transport its own sound system from one location to the next. Thus it is necessary for workmen to erect the sound system before each performance or series of performances and dismantle it for shipping to the next arena to be reassembled. Each forum also tends to be different from the rest in terms of acoustic characteristics. It will therefore be appreciated that speed and ease of installation in various configurations are also of paramount importance.

Conventional loudspeaker suspension systems are often bulky and employ an overall top hanging truss. This arrangement has proven to be cumbersome and costly due to the time and labor required to repeatedly set up such an apparatus. Loudspeaker array suspension systems should therefore be modular in nature and portable to effect their efficient and cost effective use for touring organizations. Such systems should have the capacity to suspend a variable number of equipment cabinets in any desired order. It also very important for suspension systems to be safe with minimum risk of equipment falling from its elevated position to thus avoid damage to the equipment injury to persons in the audience located below the respective pieces of equipment.

A number of solutions to the problems described above have been proposed and patented over the years. One device proposes a method of suspending a loudspeaker cabinet cluster including a pair of generally triangular pyramidal loudspeaker cabinets. The loudspeaker cabinets are mounted in close spaced adjacent relationship and pivotally coupled at adjacent front edge portions to define hinges aligned along a common hinge axis. The rear ends of the respective cabinets are connected together and spaced with respect to one another for angling the respective cabinets relative to one another about the common hinge axis. The entire apparatus is then suspended. A device of this type is disclosed in U.S. Pat. No. 5,266,751 to Taguchi. While this method is satisfactory for its intended purpose, the spaced relationship between the respective front edges of the cabinets are fixed relative to one another, thereby limiting overall adjustment of the loudspeakers. For this very same reason, any cabinet array tilting that may be accomplished due to the pyramidal shape of the cabinets is limited to a very narrow range of angles.

A similar approach utilizes modified pyramidal loudspeaker cabinets that have interlocking grooves formed in their lateral walls. The cabinets are joined together through the grooves and secured by fasteners, and then suspended from a top truss. This system has limited usefulness because it does not allow any adjustment in the orientation of the cabinets relative to each other. Furthermore, this approach does not provide for vertical stacking and suspension of multiple loudspeaker cabinets, and is therefore better suited to small venues such as clubs and auditoriums.

Applicant Andrew Martin has previously addressed some of these problems with a loudspeaker cabinet suspension system, which is the subject of application for patent 08/613029, filed on Mar. 8, 1996, now U.S. Pat. No. This suspension is comprised of truss modules mounted to the top of a cabinet and suspended directly from the particular forum's framework without the need for a top truss. The modules are designed with a pivotal joint on both ends to enable adjacent modules to be joined together in the horizontal plane. The splay angles between the various cabinets thus joined together can be adjusted through a limited range and locked by tightening down on the pivot bolt joining the pivotal joints. This device, while enjoying commercial success, suffers the shortcoming that it requires special mounts secured to the top and bottom of each cabinet in order to support a column of cabinets and to be mounted to the truss module itself. In addition, the desired splay angle is maintained solely by the friction force of the fastener joining the pivotal joints.

U.S. Pat. No. 4,660,728 to David Martin discloses a suspension system that employs a linear bar from which a column of loudspeaker cabinets is suspended. The bar has an extendible rear end from which the bottom most cabinet can be pulled by a strap and thus provide for tilting of the entire column. The bar is attached to a single point on the supporting framework by a cable connected to two mounting points located at each end of the bar. Two chains extend downward from the bar, and have coupling devices mounted to them. Each coupling device is received in a housing mounted to one side of the cabinets and is locked therein by a sliding member which engages an annular recess in the fastening peg of the coupling device. Means for locking the sliding member and enabling release of the fastening peg by manual forces in orthogonal directions are also provided. In addition the invention relies on plates to bolt together cabinets that are desired to retain the same orientation, and utilizes a webbing loop passing through retaining loops on the rear surfaces of each cabinet to keep the rear edges in tight contact. Achieving the desired configuration of the column is thus accomplished by adjusting the tensioning strap, the webbing loop, the position of the connection point on the framework relative to the chains, and the spacing of the coupling devices on the chains. This is a complicated, time consuming procedure and relies on many pieces of equipment. The housings mounted on the side walls of the cabinets contain internal moving parts that require periodic maintenance and therefore need to be disassembled. Furthermore, the housings are mounted with fasteners extending through four holes drilled in the side walls of the cabinets. This can serve to localize stress at just four points on the cabinet side wall. In addition, cabinets that are bolted together as group cause a certain amount of slack in the connecting chains, and thus each cabinet must be able to support the weight of all cabinets below it. This can place considerable strain on the side walls of the cabinets.

A similar invention that covers only a mounting plate and stud plate for pivoting suspended cabinets is described in UK Patent Application GB 2 195 139 A to Nash-De-Villers, filed on Sep. 4, 1986. This invention utilizes a D-shaped ring having a stud plate with a stud received in a keyhole slot on the mounting plate. The mounting plate is attached through an aperture drilled in the side of the cabinet to a back plate located within the cabinet itself, and includes an aperture that receives a spring loaded piston mounted on the stud. The piston is retracted manually by means of a knob. Multiple cabinets are suspended by lengths of cabling attached to the top and bottom of each D-shaped ring. Installation of this invention requires disassembly of the cabinet to place the back plate within. In addition, as with all suspension designs of this type, it is desirable to attach the mounting plates axially with each cabinet's center of gravity to ensure a stable configuration. For this reason tilting of a column of cabinets coupled together by this invention requires a tilt cable even if the amount of tilting desired is very slight because the cabinets will all naturally hang in a straight line. Furthermore, all moving parts of this invention are contained in the removable stud plates and are therefore exposed to dust, dirt, and accidental breakage during tear down and erection.

What is needed is a portable modular suspension system that will safely and adjustably support a varying number of audio equipment cabinets directly from a framework at selected orientations relative to one another and at various tilt angles with respect to the vertical. Such a system should be capable of being easily retrofitted to existing cabinets. In addition, those skilled in the art have recognized the need for such a system to accommodate a large range of splay angles and the ability to securely lock and maintain such splay angles regardless of the positioning and mounting of the cabinet array assembly. Experience has also shown that it is desirable for such equipment to be easily, quickly, and safely stored during travel to minimize damage.

SUMMARY OF THE INVENTION

Precisely arrayed loudspeaker systems are crucial for successfully entertaining or communicating to large audiences assembled in vast areas such as stadiums and other large arenas. Such systems are usually suspended from overhanging supports and repeatedly taken down and reassembled as required by the mobility of the user. Problems typically associated with using conventional arrayed loudspeaker systems include poor sound quality due to misaligned loudspeakers and costly transport, erection and dismantling due to a lack of modularity and portability. The present invention solves the aforementioned problems by providing a system for suspending an array of loudspeakers in specific spatial relation to each other. The invention allows for precise alignment of the various loudspeakers' wavefronts and acoustical centers and provides for tilting each column of vertically stacked loudspeakers. Devices for adjusting and securely fastening the various loudspeakers at selected splay angles relative to one another arc also provided.

It is an object of the present invention to provide a hollow truss bar of generally rectangular cross section with slip sleeves slidably fitting into each end of the truss bar. The slip sleeves can be securely fastened at various points within the truss bar, thus effectively increasing or decreasing the truss bar's overall length. Ring shaped mounts attached to the bottom surface of the truss bar provide mounting points for a column of audio equipment. Pivotal joints at the free end of each slip sleeve enable adjoining truss bars to pivotally interconnect at selected splay angles relative to one another, and thus adjust the acoustic wavefront and acoustic center of the overall array. Tabs attached to the rear surface of the truss bar provide bores for fastening a splay bar composed of a bar and locking slip sleeve. Two adjacent truss bars can thus be securely fastened at the selected splay angle and form a very strong and rigid triangular structure that can be mounted directly to the framework of the particular venue. A receptacle attached to the rear surface of the truss bar slidably receives a locking extension bar with ring shaped mounts attached to its upper and lower surfaces. A tilt cable attached to a mount on the extension bar and to a clip installed at the rear edge of the bottom most cabinet in the column can be adjusted to tilt the entire column of audio equipment cabinets, and thus further adjust the acoustic wavefront and position the acoustic center of the overall array.

It is a further object of the present invention to provide mounting bracket assemblies to be installed to holes formed through opposing lateral sides of audio equipment cabinets. A two piece retaining ring inside the cabinet fastens the bracket to the cabinet side. A keyhole slot on the outer surface of the bracket receives a pin on a pivotal plate, and a blocking plate within the bracket is biased against the large diameter opening of the keyhole slot to retain the pin therein. Two smaller diameter openings on diametrically opposite sides of the large diameter opening in the keyhole slot allow the particular cabinet to be suspended in an upright or an inverted configuration. The pivotal plate is generally triangular in shape and has perforations formed along the two sides that meet at the apex supporting the pin. The perforations receive a pair of cables that support the particular cabinet from an overhead support, and can receive an additional pair of cables to support another cabinet situated directly underneath the first cabinet. By using separate lengths of cabling, each pair of brackets must support only the weight of one cabinet, and the load of the underlying cabinets is transmitted through the pivotal plates to the supporting truss. In addition, slight tilting of the column may be accomplished without the use of a tilt strap simply by connecting the two cables attached to each pivotal plate at noncorresponding perforations along the two sides of the plate and allowing gravity to realign the cabinets by tilting the entire column. Different tilt angles can be achieved depending on which suspension bores the suspension cables are attached through.

It is also an object of the present invention to provide a retractable clip assembly installed at the bottom rear edge of the bottom most cabinet in a column of vertically stacked audio equipment cabinets to receive a tilt cable for tilting the column. The assembly includes a U-shaped retaining bar that has two pairs of corresponding slots engaged by a sliding plate that locks the retaining bar in either of two selected positions. An L-shaped front plate has two access openings for receiving the arms of the U clip and a rectangular aperture for accomodating the lip of the sliding plate. Bores formed along the edges of the plate allow it to be fastened along the edge of a cabinet. Holes drilled into the cabinet receive the arms of the retaining bar into the interior of the cabinet. A back plate is welded to the front plate and encloses the sliding plate and a spring biasing the blocking plate against the front plate. Two studs connect the back plate to the front plate through vertical slots in the sliding plate. The retaining bar is manually pulled out and secured by the sliding plate when the tilt strap needs to be attached to the cabinet, and is pushed back inside the cabinet interior and out of harm's way when the cabinet is packed for transport. The retaining bar can also be completely pulled out to allow for convenient attachment of the tilt strap or for replacement with a different retaining bar.

The present invention has been described in use with loudspeaker cabinets, but it will be appreciated that the invention can also be retrofitted for use with any other type of audio equipment. Other features and advantages of the invention will become apparent from the following detailed description, taken in conjunction with the accompanying drawings, which illustrate, by way of example, the features of the invention.

BRIEF DESCRIPTION OF THE DRAWINGS

FIG. 6 is a detail view, in enlarged scale, of a mounting bracket included in the apparatus shown in FIG. 2;

FIG. 7 is a side view, partially broken away, taken along line 2—2 of FIG. 6;

FIG. 9 is a detail side view, in enlarged scale, of a pivotal plate included in the apparatus shown in FIG. 2;

FIG. 10 is a bottom view of the pivotal plate shown in FIG. 9; and

DETAILED DESCRIPTION OF THE PREFERRED EMBODIMENT

Sound systems installed in large venues such as stadiums and other large arenas are typically comprised of hundreds of large loudspeakers and associated equipment suspended from overhanging supports. The technique of suspending components of a sound system from roof beams or specially erected top trusses is known in the art as "flying." Loudspeakers are elevated in this manner in order to provide the required sound coverage for large audiences at concerts both indoors and outdoors. The equipment to be flown may include loudspeakers as well as other sound processing and amplifying equipment. The loudspeakers are mounted in individual cabinets, each one containing one or more related speakers. Multiple cabinets are typically aligned in stacks or columns and elevated as a single unit. It is also frequently necessary to bow, or tilt, such columns of loudspeaker cabinets in order to extend the sound coverage provided by the loudspeakers.

Figure 1:
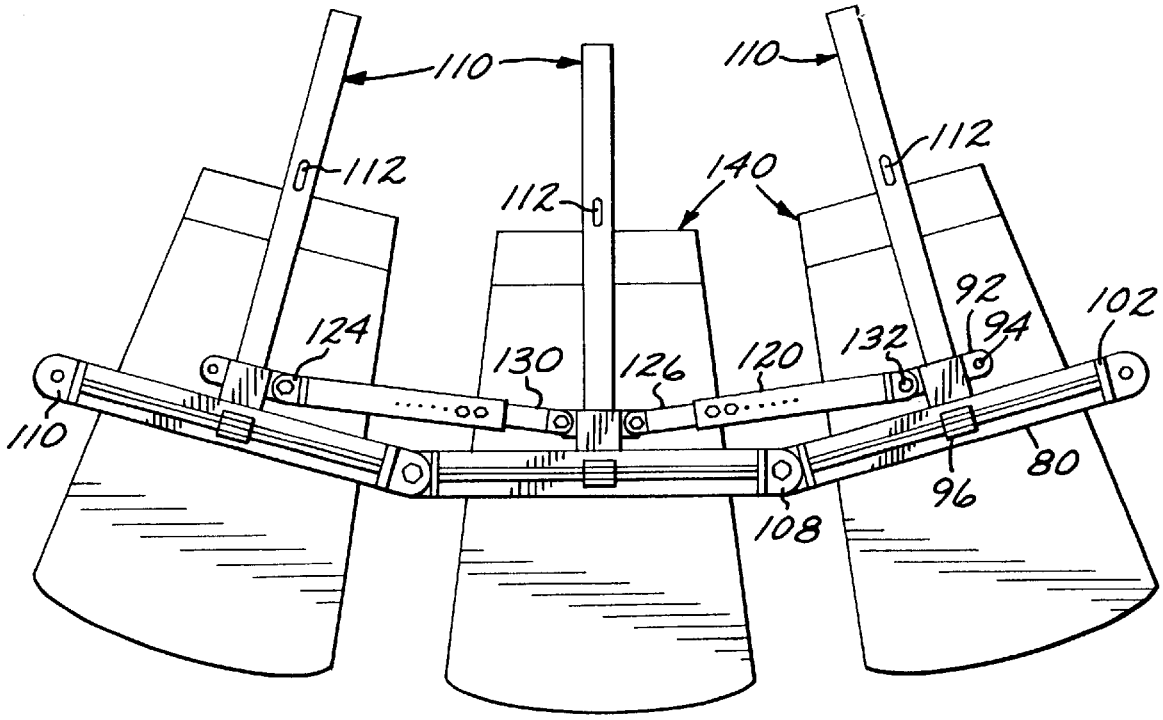
FIG. 1 is a top view of a modular pivotal suspension rigging apparatus according to the present invention.
Figure 2:
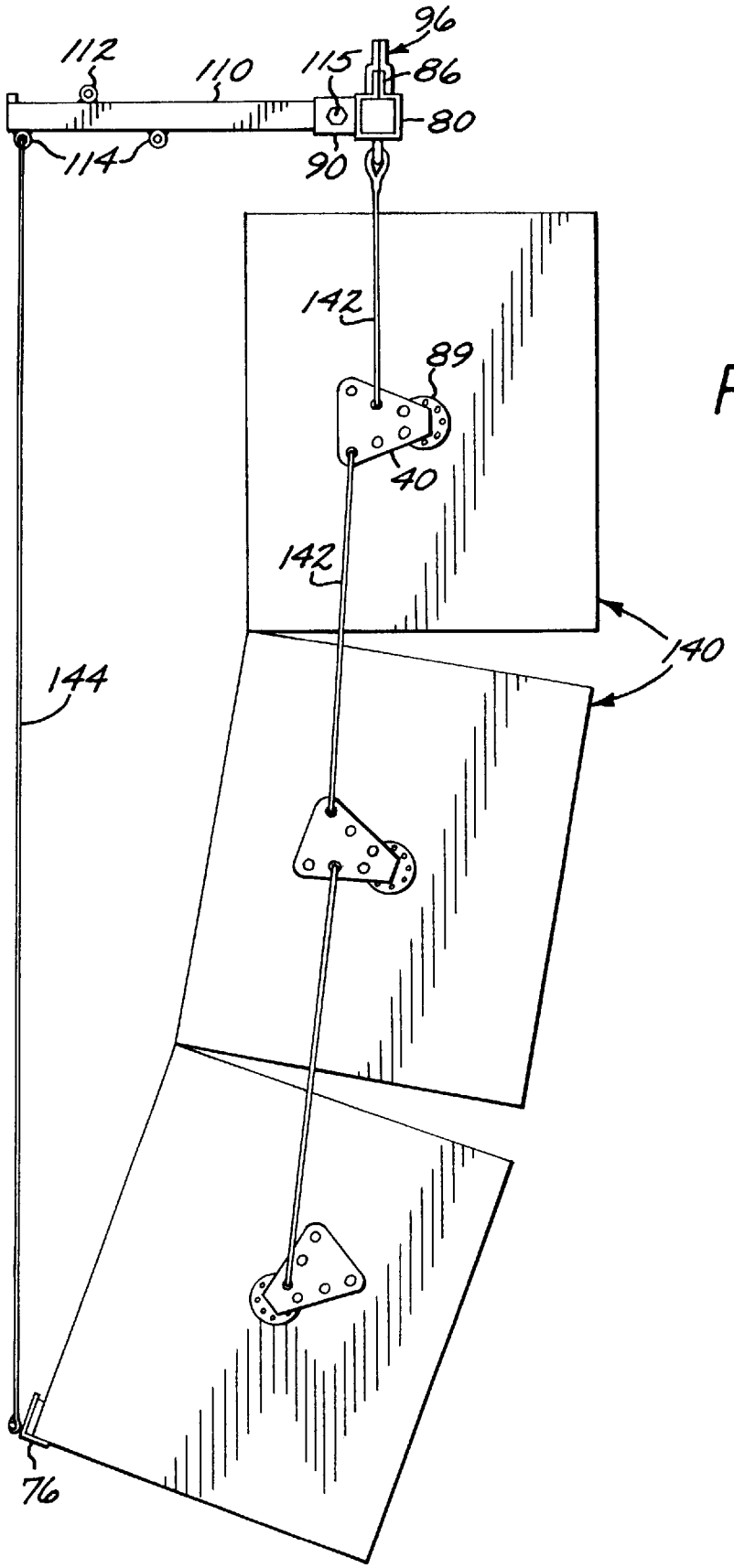
FIG. 2 is a side view of the modular pivotal suspension rigging apparatus shown in FIG. 1.

Referring to FIG. 1 for purposes of illustration, the present invention is embodied in a hardware flying apparatus that includes, generally, square open ended tubes defining female truss bars 80 having male slip sleeves 102 telescoped into the opposite ends thereof. Referring to FIG. 2, slip sleeves 102 pivotally interlock through hinge tabs 108 and 110 welded to their exposed ends, and truss bars 80 are securely locked together at selected splay angles relative to one another by a splay bar 120. Each truss bar supports a column of audio equipment cabinets 140 with lengths of cabling 142 attached to pivotal plates 40 removably locked into mounting brackets 89 installed in the side walls of the cabinets, the column of cabinets being tilted by a cable 144 connecting a pull back clip 76 installed on the bottom most cabinet to the rear of an extension bar 110 removably mounted to the rear of the truss bar.

Figure 3:
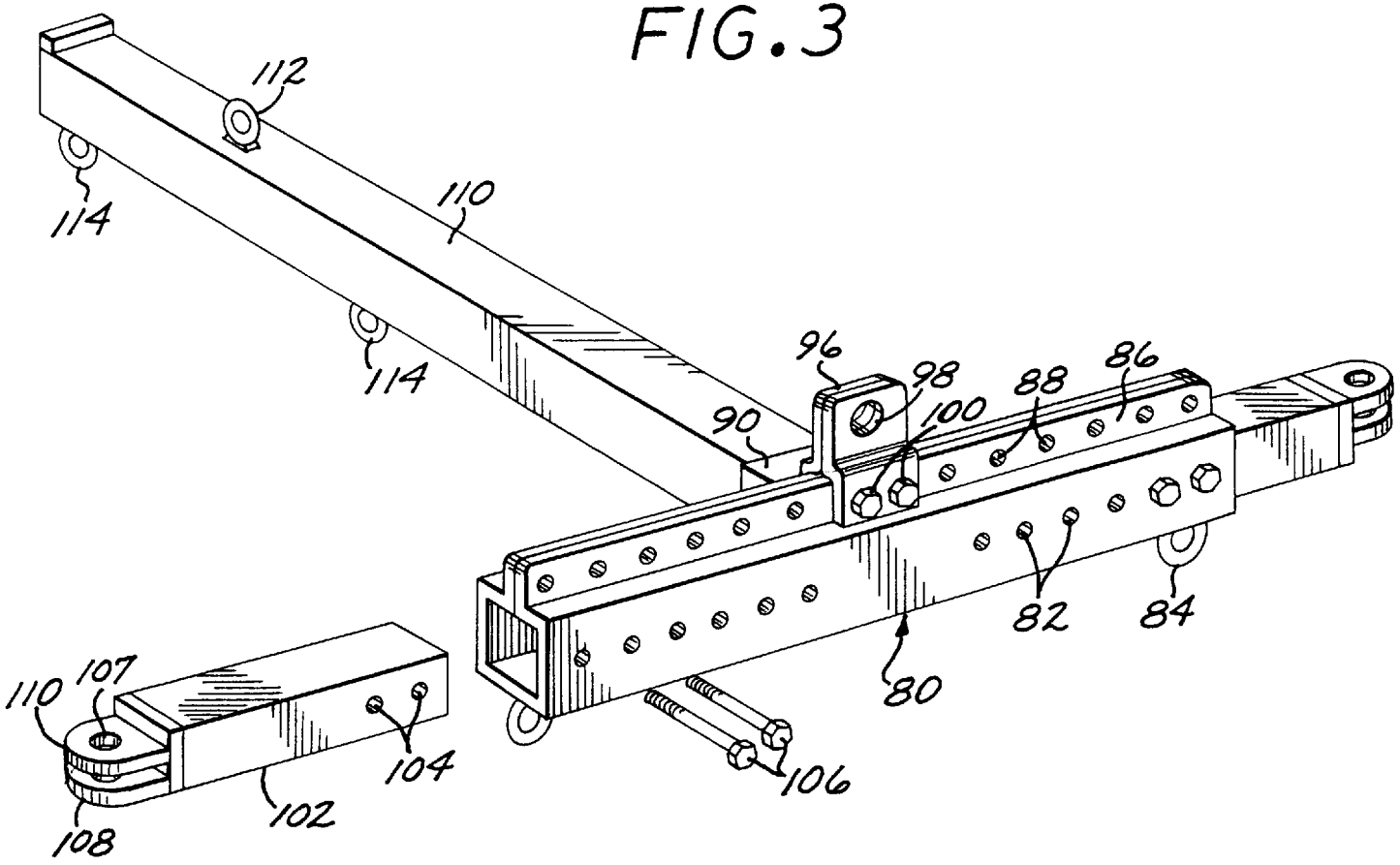
FIG. 3 is an exploded perspective view, in enlarged scale, of a truss bar and extension bar included in the apparatus shown in FIG. 1.

Referring to FIG. 3, the truss bars 80 are preferably rectangular in cross section and are formed with a plurality of equidistant openings 82 aligned along the two vertical faces that cooperate to receive bolts 106 therethrough. A suspension ring 84 is welded to the bottom surface of the truss bar at each end. The truss bar is formed from sheet metal to be configured on its top side with two parallel upturned edges that cooperate to define a suspension flange 86 extending along the entire length of the top surface of the truss bar. The suspension flange is formed with bores 88 spaced along its length to receive bolts 100 to secure an upstanding mounting bracket. The mounting bracket is formed by two identical plates formed with a saddle to straddle the flange 86 and to be fastened thereto by bolts 100. Such bracket is then formed with a vertical stem configured with a suspension bore 98.

Figure 5:
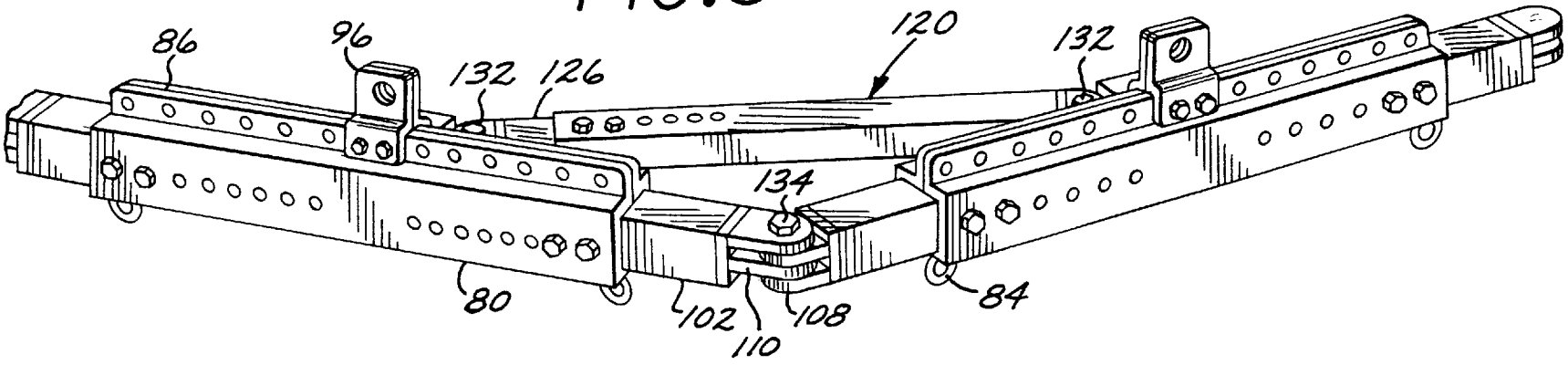
FIG. 5 is a partial perspective view, in enlarged scale, of the apparatus shown in FIG. 1.

Referring to FIG. 3, the slip sleeves 102 are sized to slidably fit into the open ends of the truss bar 80 and have a pair of bores 104 formed in the opposed vertical walls to cooperate with the bores 82 on the truss bar to receive adjustment bolts 106 to fasten the slip sleeves at selected positions relative to the truss bar. The other end of each slip sleeve is formed at the respective distal ends with respective devices that include bottom and top hinge plates 108 and 110 configured with outwardly aligned hinge bores 107. Referring to FIG. 5, the hinge plate of proximal devices may be interleaved to align the respective bores for receipt of a hinge bolt 134.

Referring to FIG. 1, mounted medially on the rear vertical surface of each of the truss bars 80 is an open ended square tube stub fitting 90 having oppositely directed horizontal tabs 92 projecting from the opposite side thereof to be formed with bores 94. Referring to FIG. 2, telescoped into the open end of the respective stub fittings are the respective one ends of extension bars, generally designated 110. Such extension bars are formed near their respective ends with a pair of aligned holes drilled in the vertical walls to receive a fastener bolt 115. Referring to FIG. 3, a suspension ring 112 is welded to the top surface of the respective extension bars and two rings 114 are welded to its bottom surface, one near the end and the other in the center.

Figure 4:
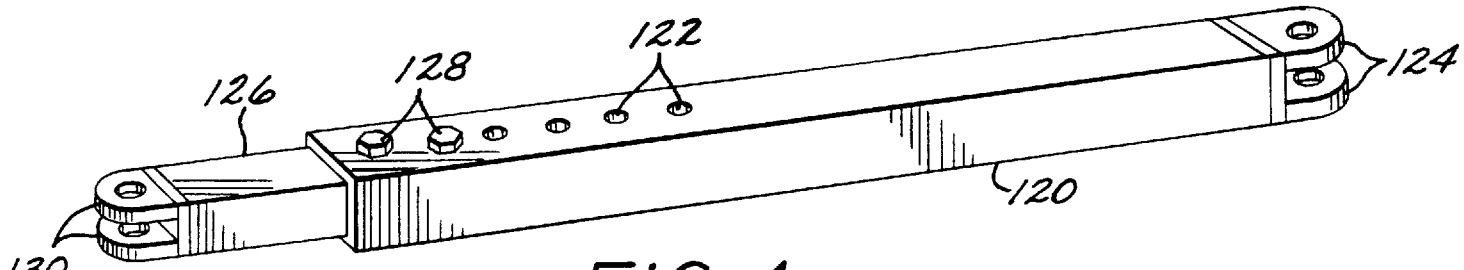
FIG. 4 is a perspective view, in enlarged scale, of a splay bar included in the apparatus shown in FIG. 1.

Referring to FIG. 4, the splay bars 120 are in the form of a square tube at one open end for telescopical receipt of respective male splay bar slip sleeves 126. Referring to FIGS. 4 and 5, mounted at the closed end of such tube is a device defining two parallel spaced apart hinge tabs 124 with aligned bores drilled therethrough for receipt of the respective horizontal tabs 92 (FIG. 1) and of respective pivot bolts 132. Referring to FIG. 4, pairs of corresponding bores 122 are drilled along two parallel surfaces of the splay bar near the open end, and cooperate with matching bores drilled in the splay bar slip sleeve to receive respective bolts 128 and to adjustably fasten the respective splay bar slip sleeves to the respective splay bars. The free ends of the respective splay bar slip sleeves include respective hinge devices defining two parallel vertical hinge tabs 130 for receipt of horizontal mounting tabs 92.

Referring to FIG. 5, a bolt 132 passing through the bores in the hinge tabs and the bore in the horizontal tab operates to pivotally lock the splay bar slip sleeve to a second truss bar adjacent to the first truss bar.

Referring to FIG. 6, the mounting bracket 89 includes a housing defined by a preferably circular front plate 13 joined to a smaller circular back plate 28 by a cylindrical peripheral wall 26. The front plate has fastener bores 12 formed along the circumference and an access opening 16 and a keyhole slot formed in the middle. The keyhole slot has two keeper channels 14 joined to and on diametrically opposite sides of a receiving opening 15. A keeper plate 18 is disposed behind the front plate. Referring to FIG. 7, two coil springs 20 are located between the keeper plate and the back plate and bias the keeper plate against the inner surface of the front plate so as to simultaneously block the keyhole opening 15 and the access opening. The coil springs are retained in their proper location by two pins 22 that extend from the inner surface of the front plate through bores in the keeper plate and through the coil springs to the back plate. Two rods 24 are located near the edge of the keeper plate abutting the cylindrical wall and act as pivot points for the keeper plate.

Figure 8:
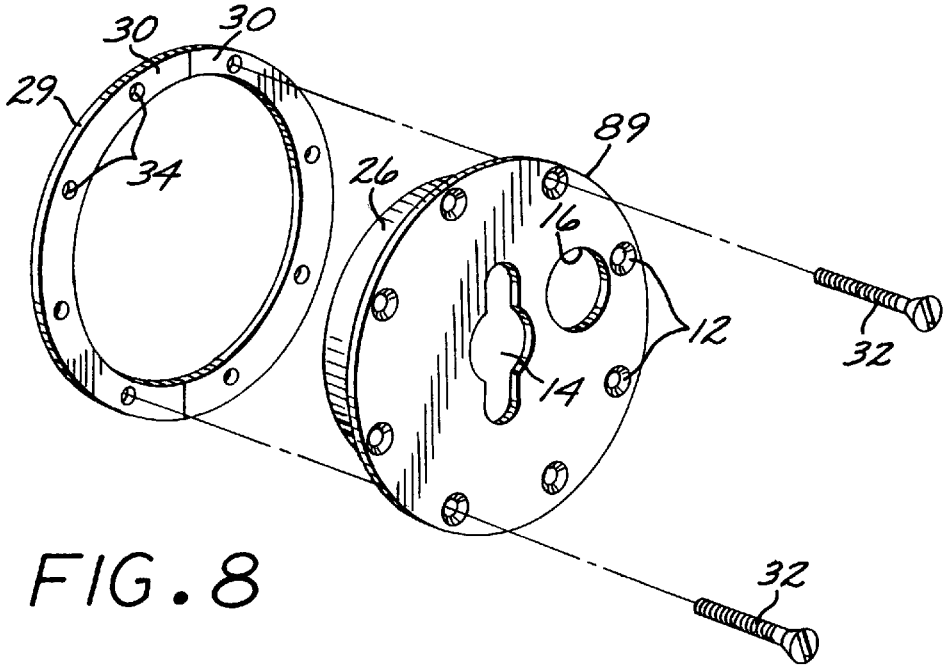
FIG. 8 is an exploded perspective view, in reduced sale, of the mounting bracket shown in FIG. 2.

Referring to FIG. 8, the mounting bracket 89 is installed by inserting the peripheral wall 26 from the outside of the equipment cabinet through a three and a half inch diameter opening drilled into the side wall of the cabinet and preferably concentric with the horizontal axis intersecting the center of gravity of the cabinet. The mounting bracket is secured to the cabinet by bolts 32 extending through the mounting bracket's fastener bores 12 and through holes drilled in the wall of the cabinet. A split ring plate, generally designated 29, is positioned inside the cabinet concentric with the cylindrical wall 26. The ring plate has bores 34 drilled therein that receive the bolts fastening the mounting bracket and thus cooperates with the mounting bracket to distribute the load placed upon the cabinet wall and reduce the loads experienced around the holes drilled in the cabinet wall. The ring plate is preferably comprised of two semi circular rings 30 that allow installation into the interior of the cabinet through the mounting bracket opening and thus obviate the need to disassemble the cabinet.

Referring to FIG. 9, the pivotal plate 40 is preferably triangular in shape and has a truncated apex at which a cylindrical base 44 is perpendicularly attached to the plate. Referring to FIG. 10, the base is of greater diameter than the keyhole slot receiving opening 15 and supports a pin 48 having a neck 46 sized to fit into the keyhole slot keeper channels 14. A plurality of suspension bores 42 are drilled in a divergent pattern along two sides of the plate extending from the truncated apex.

Figure 11:
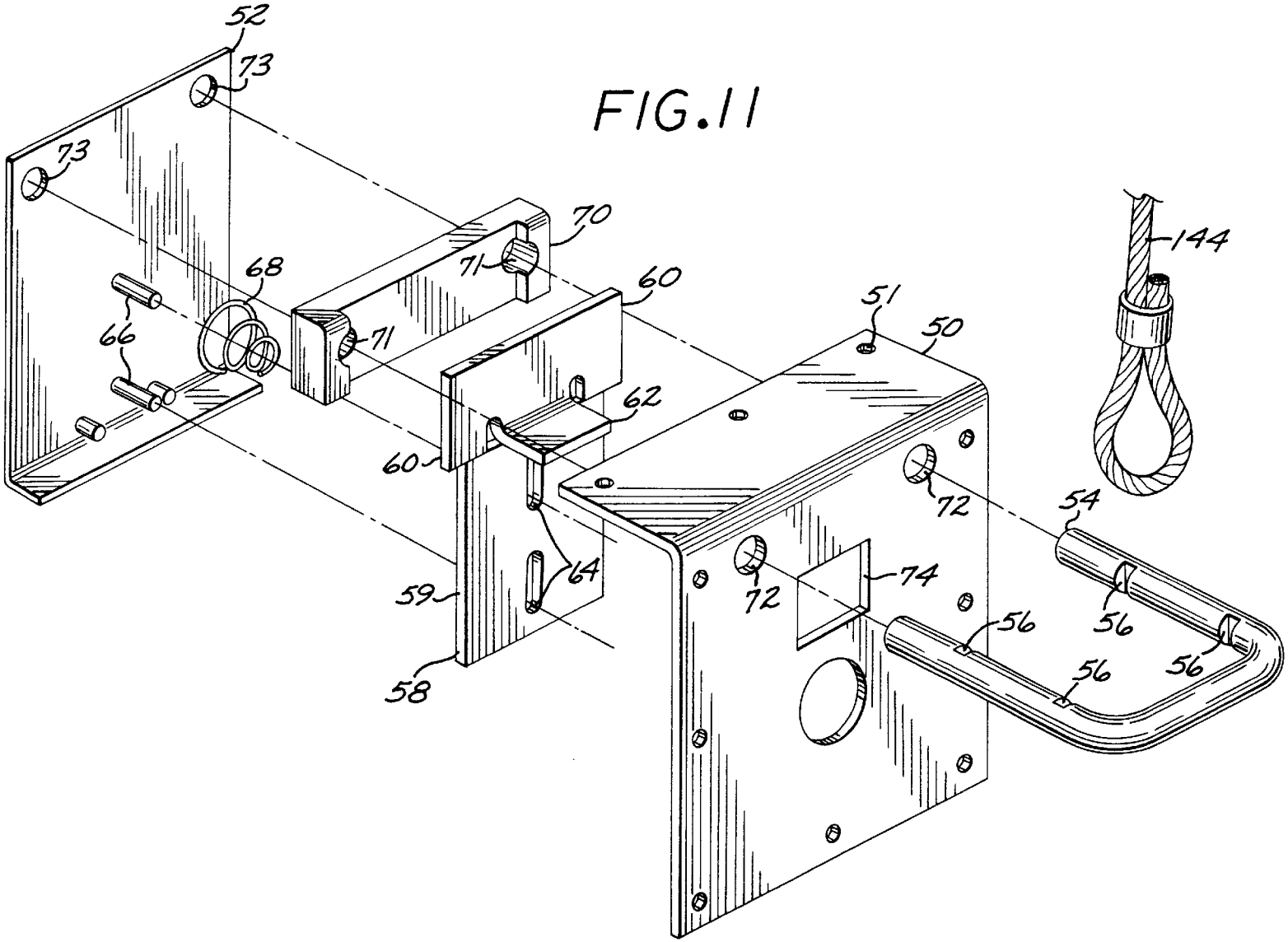
FIG. 11 an exploded perspective view, in enlarged scale, of a pull back clip assembly included in the apparatus shown in FIG. 2.

Referring to FIG. 11, the preferred embodiment of the pull back clip 76 includes an open sided housing formed by an L-shaped front plate 50 welded to a smaller L-shaped back plate 52. The housing is secured to the cabinet by fasteners passing through bores 51 formed along the edges of the front plate. The front plate is formed with a rectangular access window 74. A pair of bores 72 drilled in the front plate cooperate with matching bores 73 drilled in the back plate to slidably receive the arms of a U-shaped cable bar 54. A pair of matching holes drilled in the cabinet allow the legs of the bar to slide into the interior of the cabinet. Two vertically spaced guide pins 66 project from the back plate 52. Two pairs of confronting notches 56 are cut in the inner surfaces of the legs of the U-shaped bar in longitudinally spaced apart relation. A latch keeper bar 70 is sandwiched between the front and back plates and is formed with a pair of bores 71 to be suspended from the legs of the U-shaped cable bar. Such latch keeper is formed with a forwardly facing slot 72. A generally T-shaped latch plate, generally designated 58, is formed in its upper portion with a pair of laterally projecting latch tabs 60 and includes a downwardly depending tongue 59 formed centrally with a pair of vertically spaced apart, vertically elongated guide slots 64 slidably receiving the respective guide pins 66. A coil spring 68 surrounds one of the pins to bias the latch plate against the front plate. Vertical tabs 60 along the sides of the latch plate are sized to slide into the notches of the U-shaped bar. A finger tab 62 extends perpendicularly from the latch plate through the rectangular opening.

In operation, when the apparatus is to be suspended in an arena or concert hall, suspension cables may be attached to the suspension eyes 112 and brackets 96 to support the truss bars 80 directly from the framework of the particular venue. Referring to FIG. 3, the plurality of mounting bores 88 along the vertical flange 86 on the truss bar allow for varying the mounting point along the length of the truss bar to accommodate various supporting frameworks. The rings 84 welded to the bottom of the truss bar receive cables supporting loudspeaker cabinets and other equipment underneath the truss bar. The truss bars can be manufactured in any length to accommodate cabinets of various sizes. The bores 82 in the truss bar and the bores 104 in the slip sleeves 102 allow adjustment of the exposed length of the slip sleeves. Referring to FIG. 5, the primary purpose of the slip sleeves is to interconnect adjoining truss bars, and by changing the length of the slip sleeves the spacing of adjoining columns of cabinets can be selectively adjusted.

Referring to FIG. 5, once the proper splay angle between adjoining truss bars 80 has been achieved the bolts 134 connecting the hinge tabs 108 and 110 on the slip sleeves 102 are tightened down securely. One splay bar 120 is next connected to the vertical tabs 92 of every two adjoining truss bars and adjusted to the proper length to maintain the desired splay angle, then securely locked at that length by the bolts 128 locking in the splay bar slip sleeve 126. Two truss bars thus joined through their slip sleeves and by a splay bar form a stiff and strong triangular structure that can be securely mounted with a minimum of pick points. Adding truss bars and splay bars only strengthens the structure formed, and subject to load limitations allows for mounting to the framework with as few as three pick points. This ability greatly simplifies the requirements put on the supporting framework, reduces set up time, and enhances the safety of the rigging personnel.

Referring now to FIG. 2, the extension bar 110 provides an additional mounting, point for the truss bar 80 through the ring 112 welded to its top surface. The primary purpose of the extension bar, however, is to provide the rings 114 welded to its bottom surface for receiving a tilt cable 144 that is attached to a pull back clip 76 mounted to the bottom most cabinet and is of a length selected to achieve a particular tilt of the column of cabinets. As illustrated in FIG. 2, tilting the cabinets is made possible by the pivotal plate 40 locked into the mounting bracket 89.

Referring to FIGS. 6 and 9, the pin 48 mounted on the pivotal plate 40 is inserted into the receiving opening of the keyhole slot 14 with sufficient force to displace the keeper plate 18 and then slid into either keyhole slot keeper channel, following which the keeper plate is pushed by the coil springs 22 back against the receiving opening to thereby lock the pin into the selected keeper channel. Referring to FIGS. 2 and 10, the length of the pin neck 46 is marginally larger than the thickness of the front plate 10 and thus allows the pivotal plate to pivot within either keeper channel in a parallel plane to the mounting bracket 89 while the pin base 44 ensures that the pivotal plate and attached cables 142 do not rub against the mounting bracket or the side of the cabinet. The head of the pin is retained within the mounting bracket housing and thus prevents the pin from being pulled out of the keeper channel. The keeper plate prevents the pin from accidentally sliding out of the receiving diameter even in the event that the cabinet is turned upside down while suspended. To disengage the pin the keeper plate must first be manually displaced towards the back plate 28 of the mounting bracket through the access opening 16 formed in the front plate 10.

Referring now to FIG. 2, the suspension bores 42 drilled along one side of the pivotal plate 40 receive lengths of cabling 142 that suspend the cabinet 140 from an overhead support. The suspension perforations along the other side of the plate can be used to receive cables supporting another cabinet directly underneath the first cabinet. In this manner an entire column comprised of a selected number of cabinets can be suspended from a single overhead support. It will be appreciated that in place of cable the invention can also be used with chains, webbing, rope, or strips of metal. By placing a plurality of suspension perforations along each side of the pivotal plate the present invention allows each cabinet to be suspended within a limited range of varying angles with respect to the overhead cabinet simply by attaching the cables to the pivotal plates on each succeeding cabinet through noncorresponding suspension perforations, in effect misaligning the centers of gravity of the cabinets and thereby slightly tilting the entire column. This is a very useful feature that allows slight adjustments to be made to the tilt of the column without the need of additional equipment.

If more significant adjustments are desired, the pivotal characteristic of the invention allows severe tilt angles to be achieved by connecting the bottom most cabinet in the column through a pull back clip 76 to an overhead support by a tilt cable 144 of selected length. In this manner the column of cabinets 140 can be bowed so that the combined loudspeaker output is projected forward radially rather than unidirectionally. When such configurations are desired, it is preferable that the rear top and bottom edges of the cabinets are in contact with the edges of the adjoining cabinets to create a more stable configuration.

Referring to FIG. 11, the legs of the U-shaped bar 54 of the clip 76 slide through the bores formed in the front plate 50 and back plate 52 and keeper block 70, respectively. Matching holes drilled in the cabinet receive the legs into the interior of the cabinet and allow the bar to be pushed flush against the surface of the housing. The finger tab 62 projecting through the opening 74 in the front plate allows the user to slide the keeper plate 58 up between the keeper block and the front plate and thus engage one pair of notches 56 cut in the bar legs. In this manner the bar is locked in the flush position and cannot be pulled out without first disengaging the keeper plate by sliding it down. The other pair of notches is cut medially along the legs and allows the user to lock the bar at an additional intermediate position by disengaging the keeper plate, sliding the bar out sufficiently, and then re-engaging the keeper plate in the second pair of notches. In operation the user would typically disengage the keeper plate, pull the bar completely out of the housing, secure a loop on a cable 144 around the bar, then reinsert the bar into the housing bores and lock it in the intermediate position by sliding the keeper plate up into the medial pair of notches. When the cabinet is desired to be stored or transported, the bar can be pulled out, the cable loop removed, and then the bar can be pushed flush to the surface of the housing and locked in that position by engaging the keeper plate into the first pair of notches. The keeper plate must move in a plane parallel to the front plate to be able to engage the notches. and this objective is achieved by the coil spring 68 that biases the keeper plate against the front plate and the two guide pins 66 extending through the elongated slots 64 formed in the keeper plate that guide the keeper plate along a vertical path.

The design of the present invention offers a number of improvements that translate into significant practical advantages. Referring to FIG. 5, because the slip sleeves 102 are equipped with hinges 108 and 110, adjoining truss bars 80 can pivot relative to one another. This allows the user to finely adjust the acoustic wavefront of the entire loudspeaker array as well as manipulate the acoustic center of the individual columns. The range of possible splay angles is large and allows constructing arrays from slightly concave to fully closed circles. This allows extreme flexibility on the part of the user, who can now achieve a wide range of configurations with the same basic truss bars.

Because the structure of the present invention is relatively rigid and all members are manufactured from a high strength steel alloy, there is also no longer a need for an overall top truss supporting the columns of cabinets from the framework. Rather, the truss bars 80 and splay bars 120 form the truss and can be mounted directly on to the supporting framework. This is a tremendous advantage in terms of equipment and labor savings, because top trusses are expensive, labor and time intensive to erect and dismantle, and are typically very heavy and greatly add to the load imposed on the supporting framework. Eliminating the need for an overall truss thus not only simplifies the process of suspending loudspeakers and associated equipment, but renders it safer as well for both the crew and the audience. In addition, the quantized nature of adjustments made to the slip sleeves on the truss bars and the splay bars allows the user to precisely replicate the same exact set up time after time with no loss of accuracy due to loosened joints and the like. The need for undue experimentation every time a venue is revisited is therefore eliminated and all the user needs to do is record the proper settings for future use.

Tilting is also an important capability because by tilting a column of loudspeakers the acoustic center of the column can be manipulated. Furthermore, the sound can be projected forward radially rather than unidirectionally, which is advantageous when a loudspeaker array is located directly over a portion of the audience and the need arises to project sound downward as well as forward. Referring to FIG. 2, the tilt cable 144 can be of fixed length or can be provided with an adjusting device that allows its length to be changed according to the amount of tilt required and the number of cabinets in the column. Because the extension bar 110 is easily and quickly removed it can be used only when required and does not add to the weight of the column unnecessarily when there is no need to tilt the column of cabinets.

Referring to FIG. 7, it will be appreciated that the mounting bracket design 89 of the present invention does not include any sliding or rotating parts, and the only moving parts are comprised of a plate 18 compressing two coil springs 20. The mounting bracket can therefore be welded together permanently because there is no need for periodic maintenance to be performed on its internal workings. Coil springs are relatively impervious to moisture, dust, and other environmental factors, and can be relied on to function for the life of the mounting bracket with no need for inspection or maintenance. In addition, the simple bracket design of the present invention utilizes very few moving parts yet ensures complete and foolproof safety for any application. The pivotal plate is very easily inserted into the mounting bracket and automatically secured therein, and is just as easily removed with a simple push on the blocking plate. An additional advantage offered by the present invention is that the split ring 29 shown in FIG. 8 allows the mounting brackets to be retrofitted to existing equipment cabinets without having to disassemble the cabinets. This is a great advantage because audio equipment generally and loudspeakers in particular are designed and built to close tolerances which can easily be thrown out of alignment during reassembly, thus significantly and adversely impacting the quality of their performance.

Referring to FIG. 2, an additional and very significant advantage of the present invention is that by using a pivotal plate 40 each mounting bracket 89 carries only half of the weight of the cabinet it is mounted to, and the weight of the underlying cabinets is transmitted by the lengths of cabling 142 through the pivotal plates directly to the overhead support. The load placed on the cabinet walls is thus reduced significantly, which is a profound advantage because the cabinets themselves have historically been the weak link in any equipment suspension system.

Those skilled in the art will recognize that an advantage of the clip design of the present invention as shown in FIG. 11 is the ease with which the U-shaped bar 54 can be pulled out to completely from the clip housing. This allows the user to quickly and conveniently secure a permanently formed loop on a cable or strap 144 around the bar and subsequently reinsert the bar and lock it into the intermediate position simply by pushing the keeper plate 58 up. The design of the present invention therefore obviates the need for hooks secured to the end of the cable or for forming complex knots in the end of the cable. This is advantageous from a safety point of view because a permanent loop is stronger and safer than a knot that must be tied and untied whenever the cable must be removed from the clip. A permanently formed loop is also much more secure than a hook because a hook or similar device can be connected improperly and can also fail if overloaded. In addition, the time required to assemble and disassemble the cabinet column is reduced and labor requirements are further minimized. Furthermore, the bar can be retracted flush with the front surface and securely locked in that position by the keeper plate, and the clip housing can thus maintain a very low profile during transport that will not be accidentally snagged or hit by other equipment or personnel passing by.

From the foregoing, it will be appreciated that the present invention provides an improved system for suspending a large array of audio equipment cabinets including loudspeakers, amplifiers, and sound processors, as well as lighting and other equipment. The present invention allows for a high degree of flexibility, adjustability, and repeatability in the configurations that can be achieved while minimizing time and labor requirements and enhancing crew and audience safety. The devices comprising the present invention can be easily retrofitted to existing equipment with no need to disassemble the cabinets, and are designed with low profiles for easy and safe storage and transportation.

While a particular embodiment of the invention has been illustrated and described, various modifications can be made without departing from the spirit and scope of the invention, and all such modifications and equivalents are intended to be covered.

What is claimed is:

1. An improved modular suspension apparatus for flying audio equipment cabinets in a selected array, comprising:

a pair of elongated truss tubes with proximate open ends and including upper and lower front and back sides, said tubes including suspension flanges along the respective said upper sides;

mounting brackets adjustably mounted to the respective said suspension flanges for connection with overhead suspension cables;

suspension mounts attached to said lower sides for supporting said cabinets;

connector fittings mounted medially along the respective said back sides;

a pair of hinge devices having respective first and second extremities and configured at the respective said first extremities with respective stems telescopically received in the respective said proximate open ends, said devices being formed at the respective said second extremities with complementary hinge fittings having hinge pin bores;

hinge pins located in said hinge pin bores to pivotally interlock said hinge fittings on adjacent said hinge devices; and a variable length splay bar, having at least two pieces telescopically adjustable relative to one another said bar being pivotally connected at its opposite ends to the respective said connector fittings.

2. A suspension apparatus as set forth in claim 1, wherein:

said suspension flanges include truss fastener bores formed along their respective lengths; and said mounting brackets include respective saddles formed with respective mounting bores for selective alignment with said fastener bores and fasteners for insertion in said fastener mounting bores.

3. A suspension apparatus as set forth in claim 1, wherein:

said connector fittings comprise a pair of coplanar horizontal tabs having bores.

4. A suspension apparatus as set forth in claim 1, wherein:

said splay bar includes:

an elongated splay tube, formed with an open end, and including at the respective opposite end a hinge fitting for cooperating with the respective said connector fitting;

a splay hinge device having first and second ends configured at said first end with a stem telescopically received in the respective said open end of said splay tube and including at said second end a respective hinge fitting for cooperating with the respective said connector fitting to pivotally connect the respective said splay hinge device thereto.

5. A suspension apparatus as set forth in claim 1, wherein:

said truss tubes include respective receptacles mounted medially thereto;

elongated tilt tubes received at their respective one ends in the respective said receptacles; and suspension hooks attached to the respective said tilt tubes.

* * * * *